US009865408B2

(12) United States Patent
Vette

(10) Patent No.: US 9,865,408 B2
(45) Date of Patent: Jan. 9, 2018

(54) SWITCH EXTENSION DEVICE AND MOUNTING ASSEMBLY

(71) Applicant: Iberdrola Renewables, LLC, Portland, OR (US)

(72) Inventor: Michael Vette, Tarkio, MO (US)

(73) Assignee: Avangrid Renewables, LLC, Portland, OR (US)

( * ) Notice: Subject to any disclaimer, the term of this patent is extended or adjusted under 35 U.S.C. 154(b) by 0 days.

(21) Appl. No.: 14/934,040

(22) Filed: Nov. 5, 2015

(65) Prior Publication Data

US 2016/0126026 A1 May 5, 2016

Related U.S. Application Data

(60) Provisional application No. 62/075,791, filed on Nov. 5, 2014.

(51) Int. Cl.

| | |
|---|---|
| ***H01H 1/52*** | (2006.01) |
| ***H01H 3/20*** | (2006.01) |
| ***H01H 9/00*** | (2006.01) |
| ***H01H 9/28*** | (2006.01) |
| ***H01H 9/22*** | (2006.01) |

(52) U.S. Cl.

CPC ..... *H01H 9/282* (2013.01); *H01H 9/22* (2013.01)

(58) Field of Classification Search

CPC .. H01H 1/52; H01H 3/20; H01H 9/00; H01H 9/02; H01H 9/06; H01H 9/0264; H01H 9/20; H01H 19/00; H01H 19/02; H01H 19/04; H01H 71/00; H01H 71/02; H01H 71/10; H01H 71/52; H01H 71/521; H01H 73/00; H01H 73/02; H01H 73/06; H01H 73/10; H01H 2221/00; H01H 2221/016; H01H 2221/024

USPC ..... 200/318

See application file for complete search history.

(56) References Cited

U.S. PATENT DOCUMENTS

| | | | | |
|---|---|---|---|---|
| 4,203,083 | A * | 5/1980 | Opfer | H01H 71/10 200/400 |
| 5,219,070 | A | 6/1993 | Grunert et al. | |
| 5,288,958 | A | 2/1994 | Grunert et al. | |
| 5,319,168 | A * | 6/1994 | Hutko | H01H 3/04 200/331 |
| 5,493,083 | A | 2/1996 | Olivier | |
| 6,797,903 | B1 | 9/2004 | Winslett et al. | |
| 8,362,379 | B1 | 1/2013 | Haas et al. | |

OTHER PUBLICATIONS

Abb Inc., Low Voltage Products & Systems, Non-fusible Disconnect Switches, 94 pages (Jan. 2014).

(Continued)

*Primary Examiner* — Anthony R. Jimenez

(74) *Attorney, Agent, or Firm* — Klarquist Sparkman, LLP

(57) ABSTRACT

A switch extension device comprises an elongate extension member and an actuation member. The elongate extension member has a distal end shaped to couple with an electrical switch and a proximal end for positioning remote from the electrical switch. The actuation member is coupleable to the proximal end of the elongate extension member. The actuation member is movable to move the extension member to actuate the electrical switch. Methods of operation are also described.

17 Claims, 9 Drawing Sheets

(56) References Cited

OTHER PUBLICATIONS

Hubbell Power Systems, Products for Electric Utilities, Telecommunications and Constructions, http://www.hubbellpowersystems.com/switching/dist/padmount/design.asp (downloaded Oct. 21, 2014).
Mersen, Non-Fused Load Break Switches FSSC, SX, SXDC, SC, 5 pages (not dated).
Midwest Equipment, ABB OT16R3 3 Pole Disconnect Switch, 16 Amp, Non Fusible, 600Volt, https://www.midwestequipment.com/ot16f3-pole-disconnect-switch-fusible-600volt-p-53 . . . (downloaded Oct. 21, 2014).

* cited by examiner

SWITCH EXTENSION DEVICE AND MOUNTING ASSEMBLY

CROSS REFERENCE TO RELATED APPLICATION

This application claims the benefit of U.S. Provisional Patent Application No. 62/075,791, filed Nov. 5, 2014, which is hereby incorporated by reference.

BACKGROUND

Accessing high voltage environments, including the controls to a transformer within a transformer cabinet, requires specialized equipment and procedures to ensure the safety of all personnel.

According to one known approach, an electrical switch, such as a rotary switch mounted to the interior of the cabinet, is adapted for operation outside of the cabinet by fitting the switch with a switch extension shaft. The switch extension shaft can be locked with a padlock, e.g., to keep the switch off, at a location outside the cabinet. In this way, such a switch extension shaft can be used in conjunction with a load break switch compliant with governing safety standards, including operability of the switch when the cabinet is open and the ability to lock the switch in an off position.

There still is a need, however, to provide increased flexibility and convenience in enabling switching operations from outside of a cabinet, while still maintaining safety, that are not addressed by the known approach.

SUMMARY

Described below is a switch extension device and mounting assembly for mounting the switch extension device in a supported arrangement. The supported arrangement, including, e.g., a suspended arrangement, ensures that the extension device maintains alignment with the switch when a door to a secured area where the switch is located, or other surface to which an outer switch handle is mounted, is moved between open and closed positions. Conveniently, the new approach allows for personnel to comply with Lock-out/Tag-out requirements in place at many installations.

According to a first implementation, a switch extension device comprises an elongate extension member and an actuation member. The elongate extension member, e.g., a shaft, has a distal end shaped to couple with an electrical switch and a proximal end for positioning remote from the electrical switch. The actuation member is coupleable to the proximal end of the elongate extension member. The actuation member is movable to move the extension member to actuate the electrical switch.

The actuation member can be lockable to prevent unauthorized movement of the actuation member. A switch extension device can comprise a plate for mounting to a surface, the plate having an opening sized to receive the proximal end of the extension member such that the actuation member is lockable in place relative to the plate. The plate can define at least a first locking position and a second locking position in which the actuation member can be locked to prevent the distal end of the actuation member from actuating the electrical switch. The actuation member can be rotatable to actuate the electrical switch.

The extension member can be supported in a generally horizontal orientation. The extension member can be suspended in a generally horizontal orientation. In some embodiments, the switch extension device comprises at least one support member, and the support member is positioned along the extension member between the proximal end and the distal end. The support member is mountable to a surface to support the extension member.

The switch extension device can comprise a support assembly having a first end for mounting to a first surface, a second end for mounting to a second surface and a hanger assembly adjustably positioned between the first end and the second end. The hanger member has an opening sized to receive the extension member. In an alternative implementation, the support assembly can comprise a support rod for positioning in a generally horizontal orientation and wall plates at the first and second ends for mounting the support assembly to adjacent surfaces.

The extension member can be sized such that the proximal end is positionable outside of a securable enclosure for the electrical switch when the distal end is engaged with the electrical switch. The switch extension device can comprise a plate for mounting to a surface of the securable enclosure. The plate can have an opening shaped to receive a proximal end of the extension member and define at least a first locking position and a second locking position at which the actuation member can be locked to prevent unauthorized movement of the extension member. The actuation device can be removably coupled to the proximal end of the extension member to allow the plate to be moved proximally past the proximal end of the extension member, with the support member continuing to support the extension member.

The actuation device can be adapted for coupling with a hot stick device manipulated by an operator.

The extension member can comprise at least two extension member sections that are adjustably connected to each other.

According to a method, remotely actuating an electrical switch positioned within a secured area comprises coupling an elongate extension member to the electrical switch with a distal end of the extension member contacting the electrical switch and a proximal end of the extension member positioned to extend outside of the secured area, coupling an actuation member to the proximal end of the extension member, configuring the secured area in a secured state, and actuating the actuation member from outside the secured area to move the extension member and in turn actuate the electrical switch.

The method may also comprise supporting the extension member in a generally horizontal position using a support assembly attached to at least one surface of the secured area.

The method can also comprise positioning a plate with an opening dimension to receive a proximal end of the extension member on an exterior surface of the secured area. The plate can define at least a first locking position and a second locking position at which the actuation member can be locked to prevent rotation relative to the plate.

The extension member can be positioned to extend through a door providing access to the secured area. The plate can be positioned on an exterior surface of the door such that when the actuation member is removed from the proximal end, the door can be opened and the extension member remain supported by the support assembly. Actuating the actuation member from outside the secured area can comprise contacting the actuation member with a hot stick device and rotating the actuation member to in turn rotate the extension member and the electrical switch.

The foregoing and other objects, features, and advantages will become more apparent from the following detailed description, which proceeds with reference to the accompanying figures.

DETAILED DESCRIPTION

Figure 1:
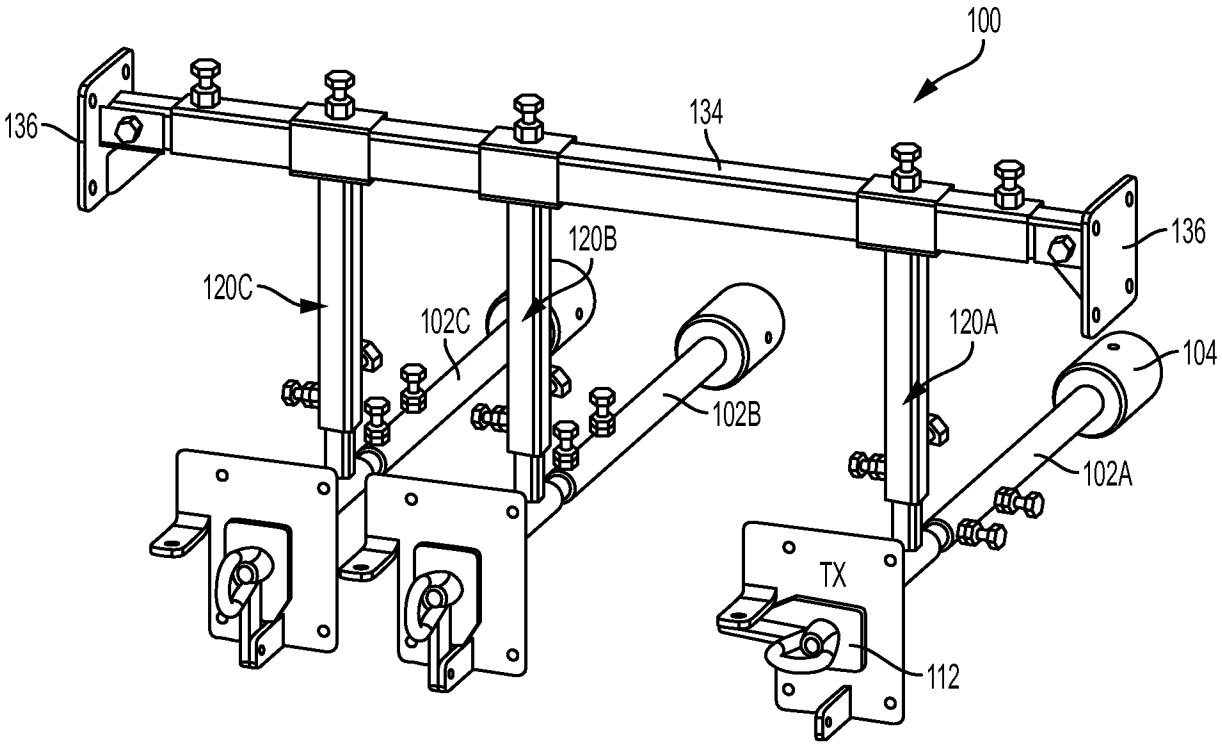
FIG. 1 is a perspective view of a new switch extension device and a related mounting assembly.
Figure 4A:
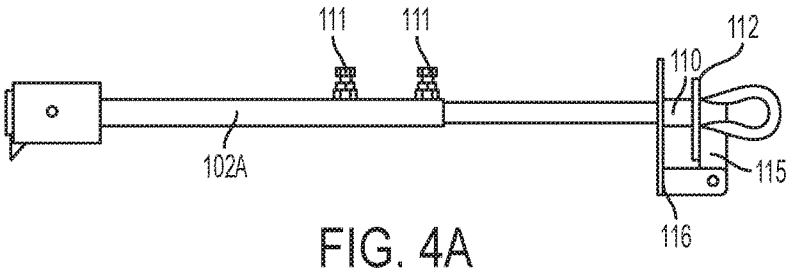
FIGS. 4A, 4B, 4C and 4D are top plan, side elevation, front elevation and perspective views, respectively, of the new switch extension device.
Figure 4C:
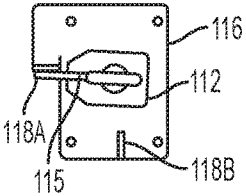
Figure 6:
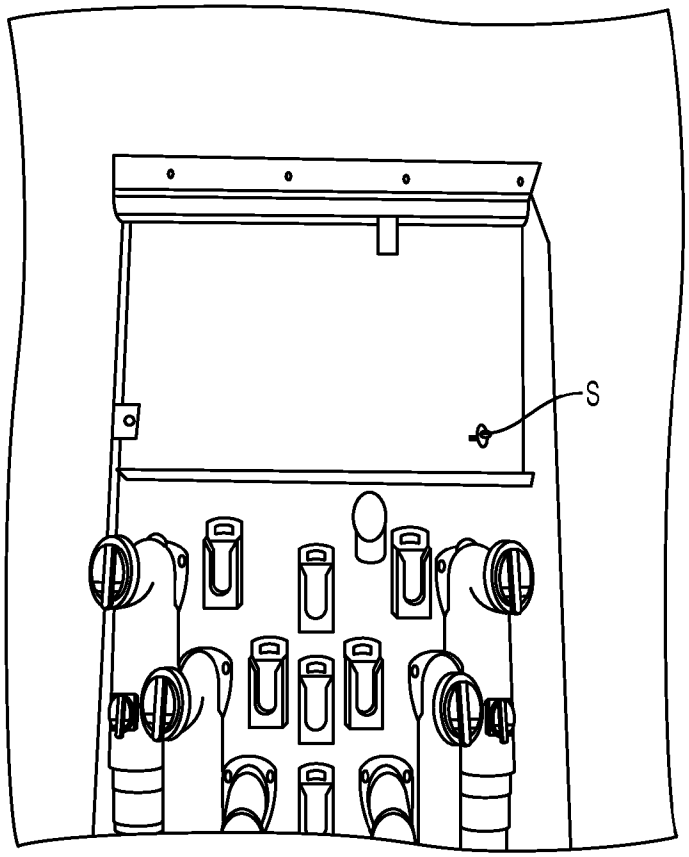
FIG. 6 is an elevation view of a portion of an electrical panel having a switch with which the new switch extension device can be used.

Referring to FIG. 1, a new mounting assembly 100 for one or more switch extension shafts is shown. A representative first switch extension member or shaft 102A has a switch socket 104 at its distal end for engaging an electrical switch and a proximal exposed end 110 (FIG. 4A) with an actuation member or switch handle 112. A representative switch S is shown in FIG. 6 mounted on a panel and shown with other associated electrical equipment. The switch socket 104 and the switch handle 112 can be connected together by one or more shaft sections, such as a distal shaft section 106 and a proximal shaft section 108 (FIG. 2A). Such separate shaft sections can be secured together by fasteners 111 or other mechanical fastening arrangement, as described in further detail below.

As shown in FIG. 1, the assembly 100 can include multiple switch extension shafts, such as second and third switch extension shafts 102B and 102C as shown, in addition to the first switch extension shaft 102A. Each switch extension shaft can be positioned to operate a separate switch, which provides for greater convenience and safety.

Figure 2B:
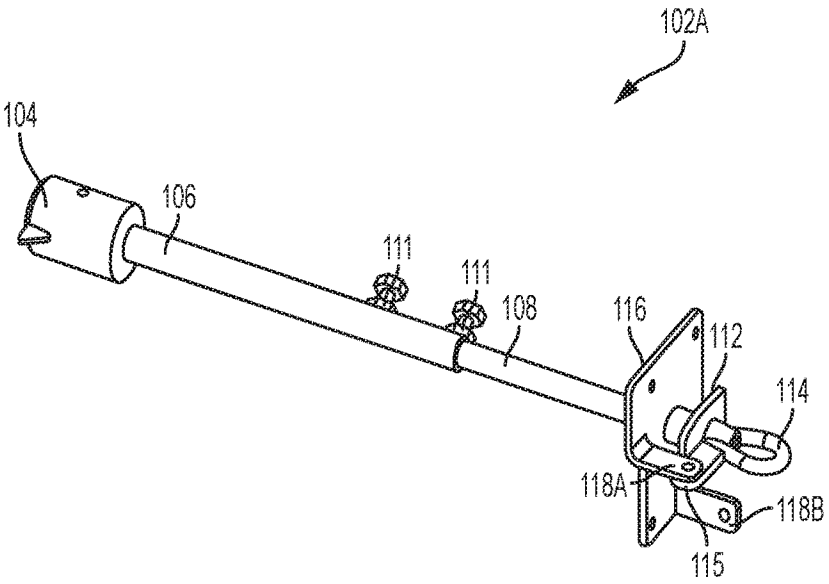
FIG. 2B is a perspective view of the new switch extension device of FIG. 2A from a different perspective.
Figure 2A:
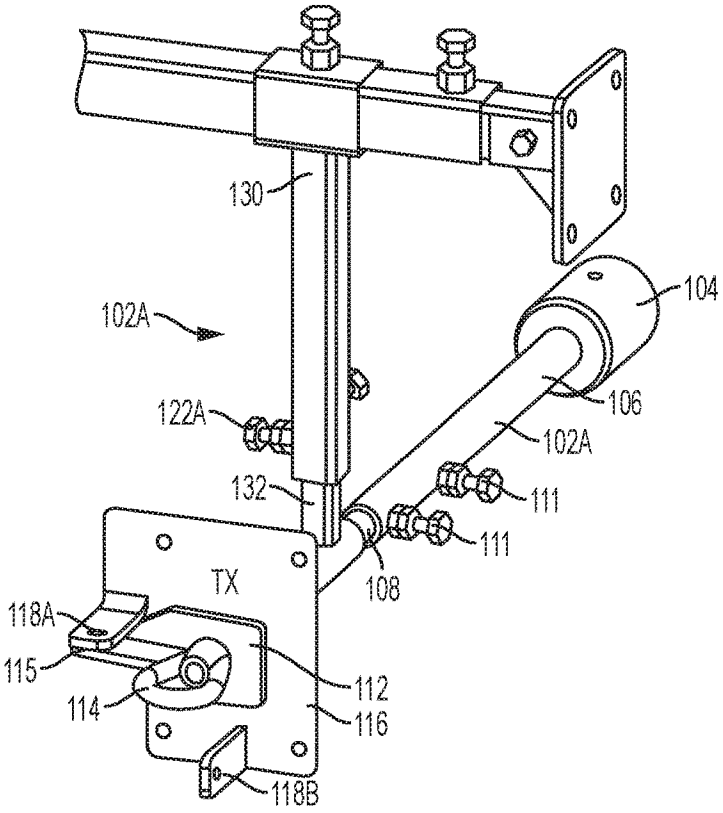
FIG. 2A is an enlarged perspective view of a portion of the new switch extension device and mounting assembly of FIG. 1.
Figure 4B:
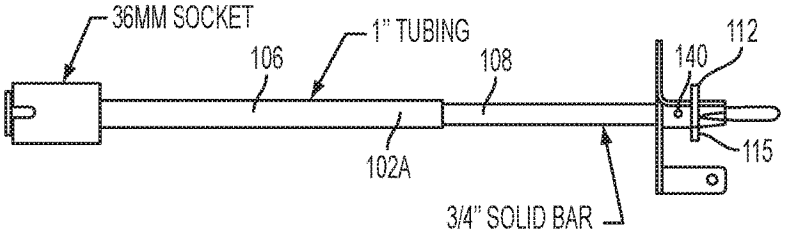
Figure 4D:
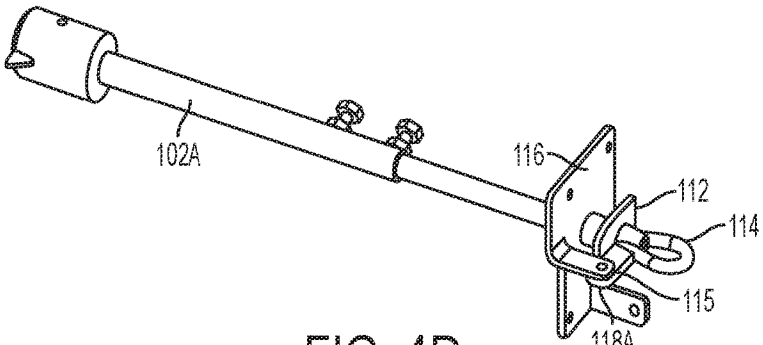

Referring to FIGS. 2A and 2B, the switch extension shaft 102A extends through a plate 116 that is typically affixed to a vertical surface, e.g., a door, which is movable relative to the switch. The plate 116 can have identifying indicia, such as "TX" as shown, to indicate the switch to which the corresponding switch extension shaft can be coupled. The switch handle 112 can have a loop 114 or other similar structure configured to allow coupling with a hot stick H (FIG. 11) or other implement allowing remote actuation/operation of the switch handle. The switch handle 112 is removably coupled to the proximal end 110 of the shaft, such as with a pin 140 (FIG. 4B).

Figure 10:
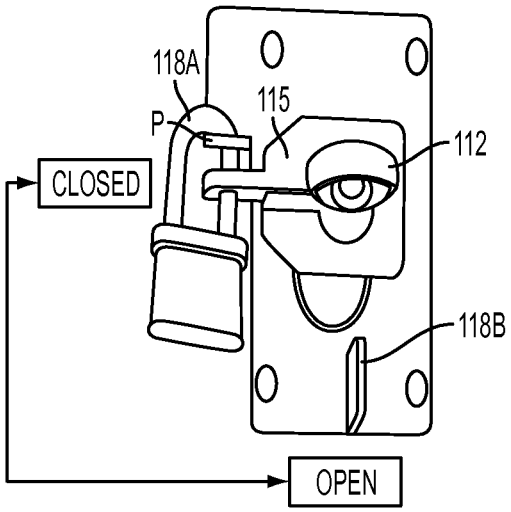
FIG. 10 is an elevation view of the plate showing the actuation member or handle locked in a closed position to prevent rotation of the actuation member relative to the plate.

The switch handle 112 can also have a locking member 115 engageable with a padlock shackle P (FIG. 10). The plate 116 can have one or more lock openings, such as the lock openings 118A, 118B, also configured to receive the padlock shackle P. In this way, the switch handle 112 can be locked in a desired one of several possible positions to prevent it from being rotated to change the position of the corresponding switch, i.e., the TX switch in this example. In operation, when it is desired to open the door, any padlocks must be unlocked and removed, the switch S must be in a predetermined position, and the switch handle 112 must be uncoupled from the shaft. The shaft remains supported at the proper position to allow the door to be closed after work within the cabinet is complete, with the aligned opening in the plate 116 and door passing over the proximal end 110 of the shaft.

Figure 9:
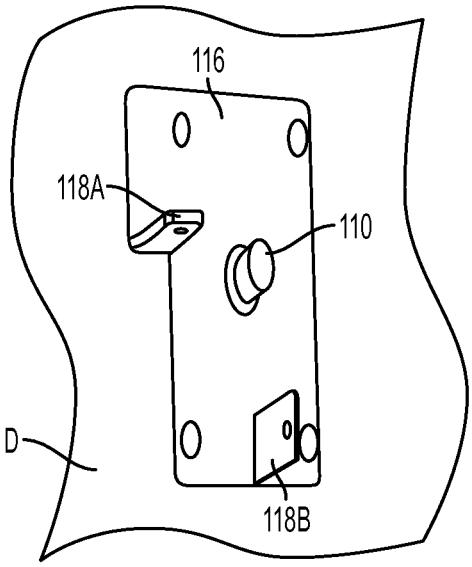
FIG. 9 is an elevation view of a portion of a door to a secured area on which a plate for use with the switch extension device is mounted.

FIG. 9 shows the plate 116 mounted to a representative door D and after the switch handle 112 has been removed, such that the exposed end 110 of the shaft projecting through an opening in the plate 116 is visible. FIG. 10 is similar to FIG. 9, but shows the switch handle 112 coupled to the exposed end 110 and locked in the switch "CLOSED" position with the padlock shackle P extending through the aligned locking member 115 and lock opening 118A.

Figure 3:
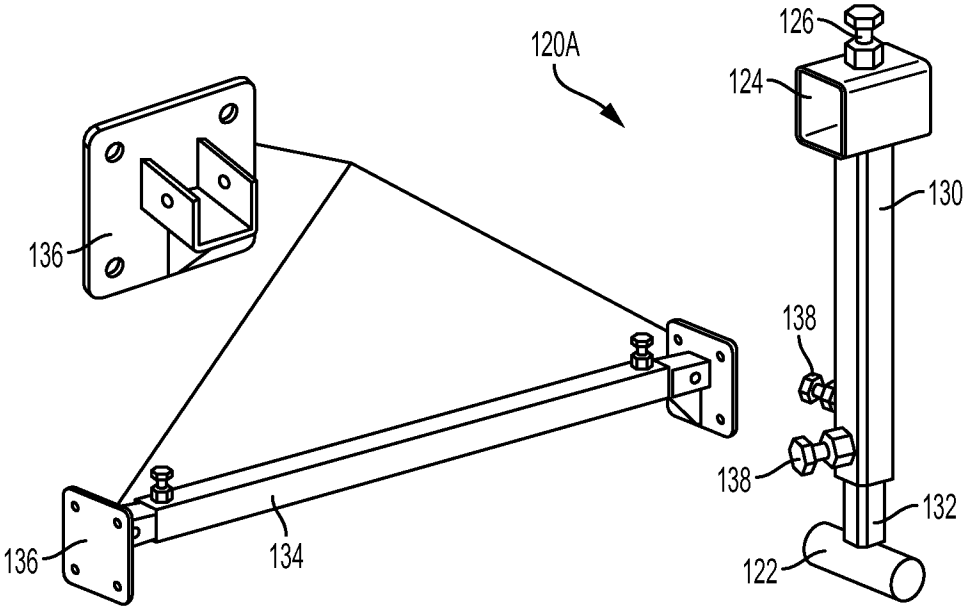
FIG. 3 is a perspective view showing the mounting assembly.

The switch extension shaft 102A can be supported, such as in a generally horizontal orientation as shown, by a hanger support 120A. As best shown in FIG. 3, the hanger support 120A can have a shaft receiving section 122 configured to receive the switch extension shaft 102A and an opposite support end, such as a hanger section 124. In the illustrated embodiment, the hanger section 124 is also adjustably positioned, such as by coupling it at a desired position along a horizontal support rod 134. In this way, the switch extension shaft 102A can be supported in a desired orientation, including when the door to which the plate 116 is affixed is moved from a closed position to an open position, which desirably keeps the switch socket 104 aligned so that it can be repositioned over the switch when the door is returned from the open position to the closed position.

Figure 7:
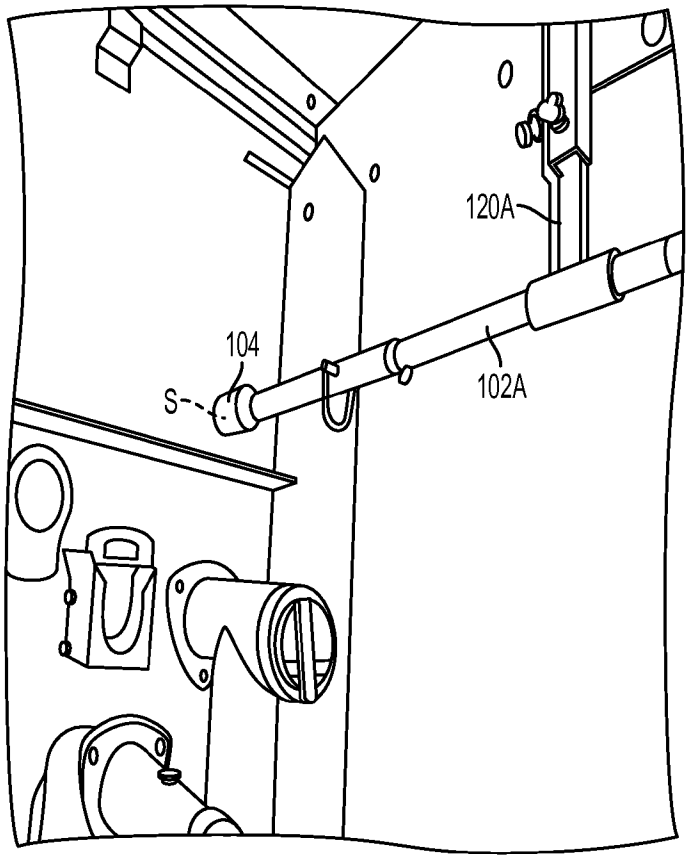
FIG. 7 is a perspective view showing the switch extension device engaged with the switch of FIG. 6.

The switch socket 104 is shown engaged with the switch S in FIG. 7. In some implementations, the switch socket 104 is secured to the switch S. For example, the socket 104 can be fastened to the switch S with a ¼ inch bolt or other suitable fastening arrangement.

Figure 8:
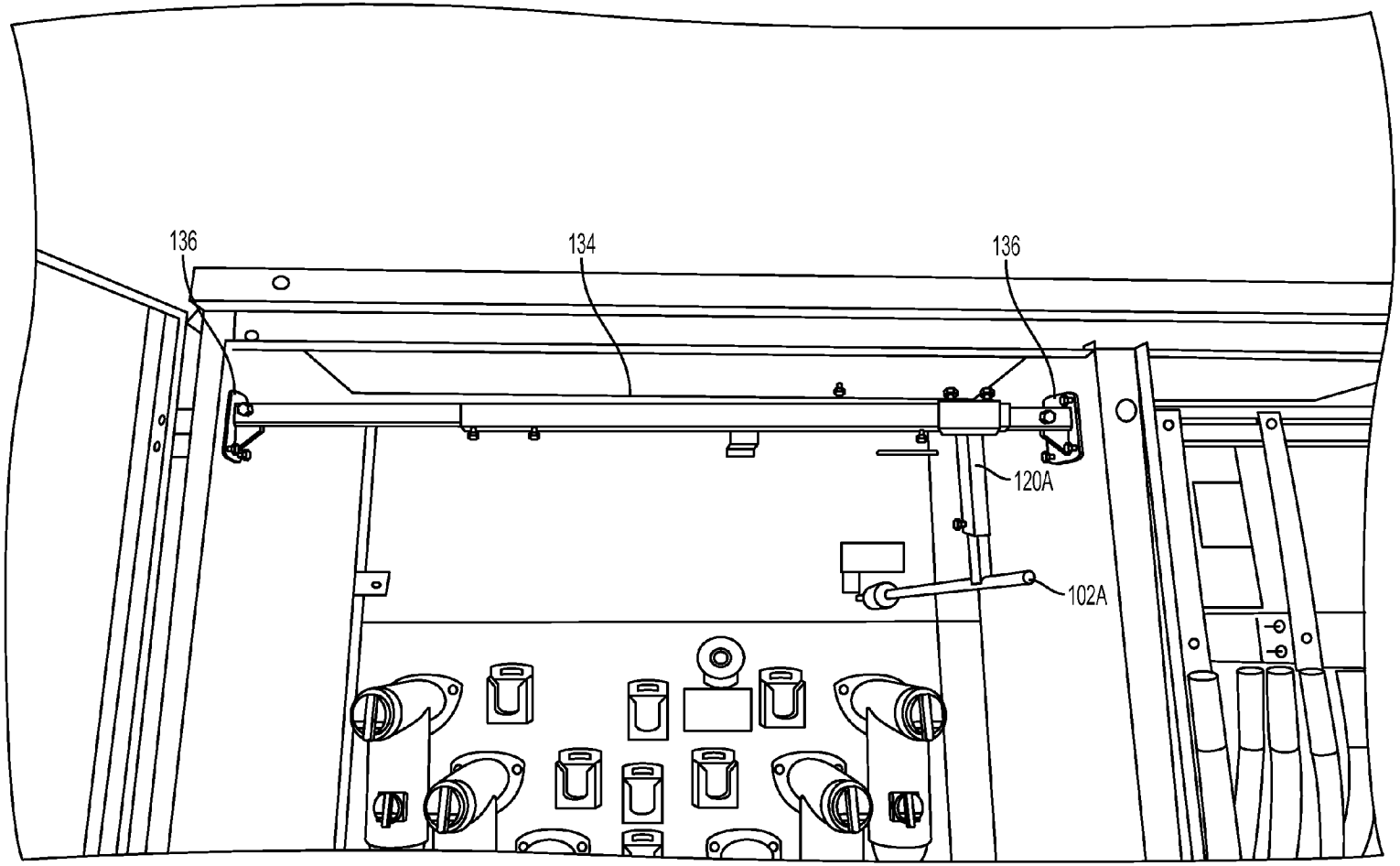
FIG. 8 is an expanded elevation view of the electrical panel of FIGS. 6 and 7 showing the mounting assembly as mounted to support the switch extension device.

The support rod 134 can be mounted by any suitable arrangement, including between wall plates 136 so as to extend approximately horizontally, such as is shown in FIG. 8. The hanger support 120A can be comprised of one or more sections, such as an upper section 130 and a lower section 132 as shown. The sections 130, 132 may be removably coupled together, such as by using fasteners 138. The support rod 134 and hanger supports, such as the hanger support 120A, provide great adjustability for installing the assembly in a variety of different environments.

The support rod 134 can have any suitable cross-section, such as a square cross section as shown. The hanger section 124 can have a configuration adapted to correspond to the support rod 134, such as a square tubing cross section as shown. The hanger section 124 can have a fastener 126 or other element to adjustably lock the hanger section 124 in a desired lateral position along the support rod 134.

The shaft receiving section 122 can be configured as shown to permit the switch extension shaft 102A to be rotated while it is being supported. For example, the shaft receiving section 122 can be formed from a section of tubing.

FIGS. 4A, 4B, 4C and 4D are top plan, side elevation, front elevation and perspective views, respectively, of the switch extension shaft 102A and plate 116. As described above, the switch extension shaft 102A can have the pin 140 or other similar element to removably couple the switch handle 112 to the proximal exposed end 110. For greater security and safety, the pinned connection can be configured such that if a padlock shackle is locked through the locking member 115 on the handle 112 and one of the lock openings 118A, 118B, such as the lock opening 118A as shown, then the handle 112 cannot be removed even if the pin 140 is removed.

Figure 5:
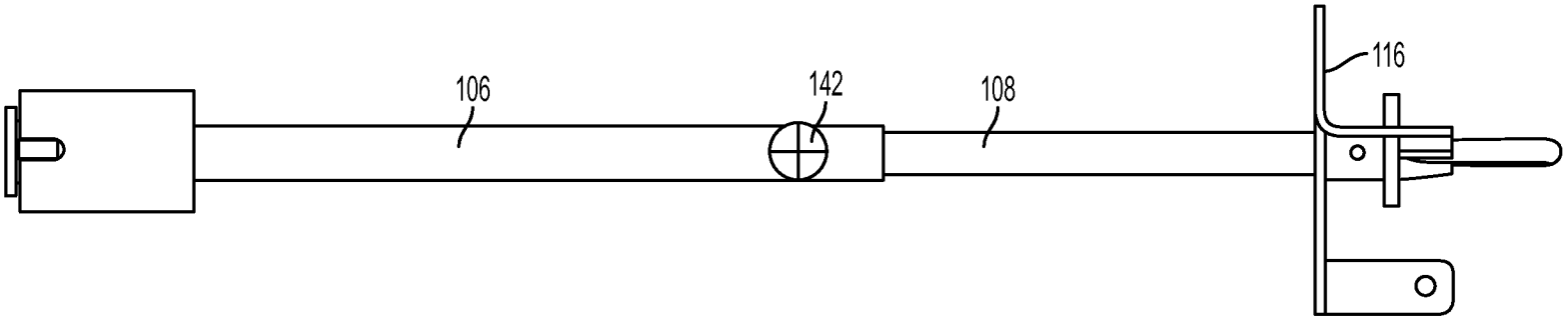
FIG. 5 is a top plan view of the new switch extension device showing a junction between sections of the device.

In some implementations, the proximal shaft section 108 can be formed from ¾ inch solid metal round bar stock, and the distal shaft section 106 can be formed of 1 inch metal tubing dimensioned to receive the ¾ inch bar stock. The shaft sections 106, 108 can be removably secured together, such as with fasteners 111. In another implementation as shown in FIG. 5, the distal shaft section 106 and the proximal shaft section 108 are attached together at a pinned connection 142 to provide a more robust connection once the precise positioning for best operation has been determined.

Figure 11:
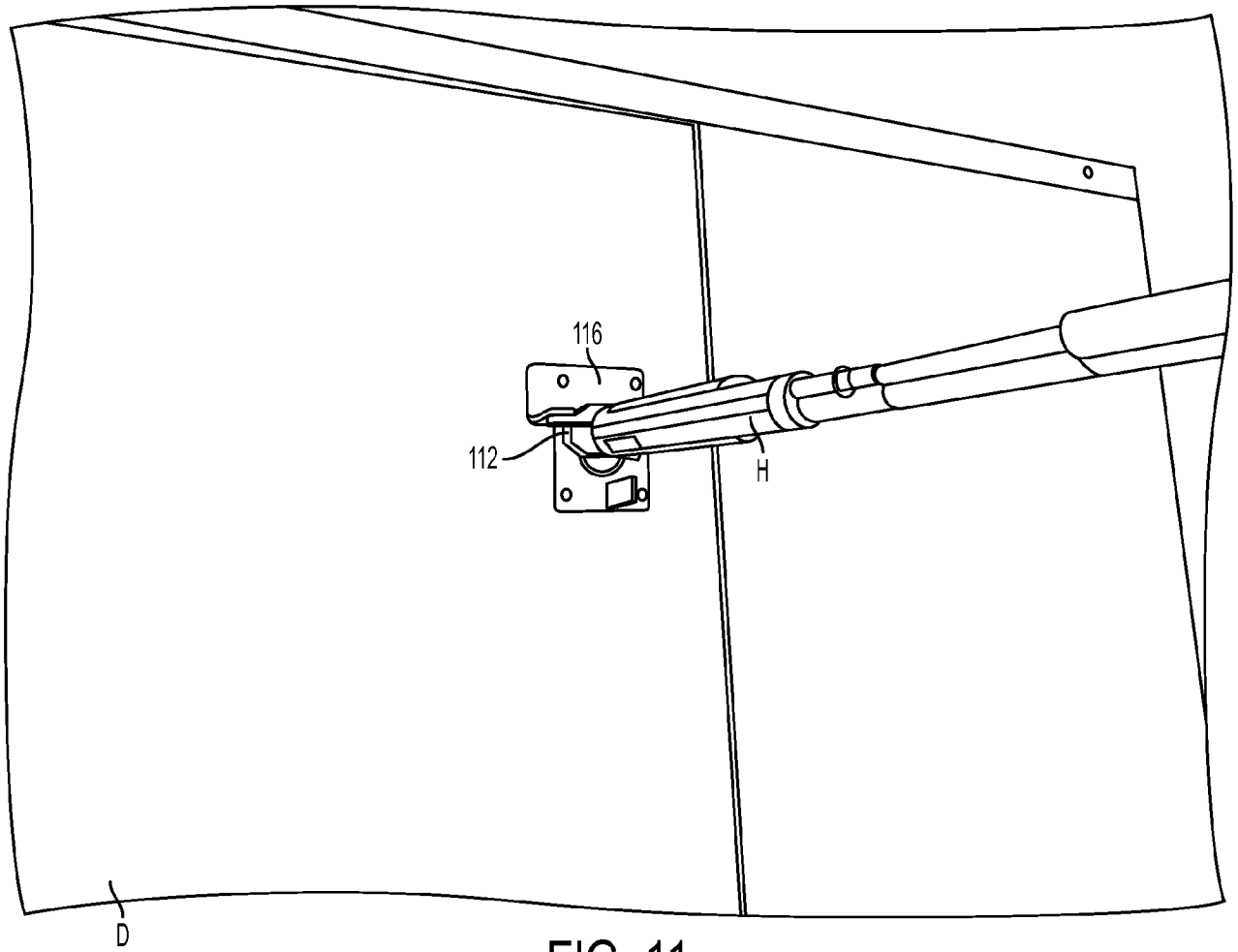
FIG. 11 is an enlarged elevation view of a portion of the door showing a hot stick device being used to engage the actuation member of the switch extension device.

As shown in FIG. 11, in some implementations, an operator uses a hot stick device H for added safety when actuating the switch S via the switch extension shaft 120A. The operator fits the hot stick device over the switch handle 112 and rotates the device, which in turn rotates the switch handle 112 and the switch S. In this way, the operator can safely move the switch to the desired position.

In view of the many possible embodiments to which the disclosed principles may be applied, it should be recognized that the illustrated embodiments are only preferred examples and should not be taken as limiting the scope of protection. Rather, the scope of protection is defined by the following claims. We therefore claim all that comes within the scope and spirit of these claims.

We claim:

1. A switch extension device, comprising:

an elongate extension member having a distal end shaped to couple with an electrical switch and a proximal end for positioning remote from the electrical switch, the extension member defining an axis;

at least one support member positioned at a point along the extension member spaced from the proximal end and spaced from the distal end to support the extension member in a substantially horizontal position, the support member having a sleeve dimensioned to receive the extension member; and an actuation member coupleable to the proximal end of the elongate extension member, the actuation member being movable to rotate the extension member about the axis and within the sleeve to actuate the electrical switch.

2. The switch extension device of claim 1, wherein the actuation member is lockable to prevent unauthorized movement of the actuation member.

3. The switch extension device of claim 1, further comprising a plate for mounting to a surface, the plate having an opening sized to receive the proximal end of the extension member, and wherein the actuation member is lockable in place relative to the plate.

4. The switch extension device of claim 1, wherein the plate defines at least a first locking position and a second locking position in which the actuation member can be locked to prevent the distal end of the actuation member from actuating the electrical switch.

5. The switch extension device of claim 1, wherein the support member supports the extension member by suspending the extension member in the substantially horizontal orientation from above.

6. The switch extension device of claim 1, wherein the support member is mountable to a surface to support the extension member.

7. The switch extension device of claim 1, wherein the actuation member is adapted for coupling with a hot stick device manipulated by an operator.

8. The switch extension device of claim 1, wherein the extension member comprises at least two extension member sections that are adjustably connected to each other.

9. The switch extension device of claim 1, further comprising a transverse support assembly positionable transverse to the axis of the extension member and having a first end for mounting to a first surface and a second end for mounting to a second surface, and wherein the support member is adjustably coupled to the support assembly to position the extension member in the substantially horizontal position.

10. The switch extension device of claim 9, wherein the support assembly comprises a support rod for positioning in a substantially horizontal orientation and wall plates at the first and second ends for mounting the support assembly to adjacent surfaces.

11. The switch extension device of claim 9, wherein the elongate extension member has a length sized such that the proximal end is positionable outside of a securable enclosure for the electrical switch when the distal end is engaged with the electrical switch.

12. The switch extension device of claim 11, further comprising a plate for mounting to a surface of the securable enclosure, the plate having an opening shaped to receive a proximal end of the extension member and defining at least a first locking position and a second locking position at which the actuation member can be locked to prevent unauthorized movement of the extension member.

13. The switch extension device of claim 12, wherein the actuation member is removably coupled to the proximal end of the extension member to allow the plate to be moved proximally past the proximal end of the extension member while the support member continues to support the extension member.

14. A method of remotely actuating an electrical switch positioned within a secured area, the method comprising:

coupling an elongate extension member defining an axis to the electrical switch with a distal end of the extension member contacting the electrical switch and a proximal end of the extension member positioned to extend outside of the secured area;

supporting the extension member in a substantially horizontal position using a support assembly attached to at least one interior surface of the secured area and having a sleeve shaped to receive the extension member;

coupling an actuation member to the proximal end of the extension member;

configuring the secured area in a secured state; and actuating the actuation member from outside the secured area to rotate the extension member about the axis and within the sleeve of the support member and in turn actuate the electrical switch.

15. The method of claim 14, further comprising positioning a plate with an opening dimensioned to receive a proximal end of the extension member on an exterior surface of the secured area, the plate defining at least a first locking position and a second locking position at which the actuation member can be locked to prevent rotation relative to the plate.

16. The method of claim 14, wherein the extension member is positioned to extend through a door providing access to the secure area and the plate is positioned on an exterior surface of the door, and wherein when the actuation member is removed from the proximal end, the door can be opened and the extension member remains supported in the substantially horizontal position by the support assembly.

17. The method of claim 14, wherein actuating the actuation member from outside the secured area comprises contacting the actuation member with a hot stick device and rotating the actuation member to in turn rotate the extension member and the electrical switch.

* * * * *